US009153902B1

(12) United States Patent
Davies et al.

(10) Patent No.: US 9,153,902 B1
(45) Date of Patent: Oct. 6, 2015

(54) IMPACT LOAD TRANSFER MOUNT FOR CONNECTORS

(71) Applicant: Amazon Technologies, Inc., Reno, NV (US)

(72) Inventors: Joshua Paul Davies, Fremont, CA (US); Angel Wilfredo Martinez, Cupertino, CA (US); Andrew McIntyre, San Francisco, CA (US); Brandon Michael Potens, Campbell, CA (US)

(73) Assignee: Amazon Technologies, Inc., Reno, NV (US)

( * ) Notice: Subject to any disclaimer, the term of this patent is extended or adjusted under 35 U.S.C. 154(b) by 174 days.

(21) Appl. No.: 13/828,834

(22) Filed: Mar. 14, 2013

(51) Int. Cl.
*H01R 12/00* (2006.01)
*H01R 13/60* (2006.01)

(52) U.S. Cl.
CPC ..... *H01R 13/60* (2013.01)

(58) Field of Classification Search
USPC ..... 439/247, 248, 542, 527, 574
IPC ..... H01R 23/7073,23/7068, 23/6874, 13/6658, H01R 13/658, 13/5202
See application file for complete search history.

(56) References Cited

U.S. PATENT DOCUMENTS

| | | | | |
|---|---|---|---|---|
| 2,938,188 | A * | 5/1960 | Lazzery | 439/544 |
| 3,954,318 | A * | 5/1976 | Larson et al. | 439/248 |
| 6,520,792 | B2 * | 2/2003 | Chen-Chiang et al. | 439/373 |
| 2008/0238458 | A1 * | 10/2008 | Eldridge | 324/754 |
| 2011/0244718 | A1 * | 10/2011 | Long | 439/527 |

* cited by examiner

*Primary Examiner* — Hien Vu
(74) *Attorney, Agent, or Firm* — Sutherland Asbill & Brennan LLP

(57) ABSTRACT

Certain embodiments herein relate to mounting configurations for transferring forces or loads away from connectors for a device. A mounting element may be secured to a connector and, in response to the connector receiving a certain amount of force, may move the connector to a surface or an element associated with the device that may be more suitable for withstanding the force. Various positions of a mounting element with respect to a connector, and/or geometric variations of the mounting element, may allow the mounting element to move the connector in multiple planes, such as vertical, horizontal, and/or diagonal.

23 Claims, 6 Drawing Sheets

IMPACT LOAD TRANSFER MOUNT FOR CONNECTORS

BACKGROUND

Various devices may include one or more connectors for enabling audio, data, or other types of peripheral communication with the devices. Such connectors may receive plugs or other types of external connectors associated with peripheral devices, for example, to facilitate such communication. Unfortunately, inadvertent or excessive external forces that may be applied to the connectors, such as those which may result from a user tripping over a cord associated with an external connector, a user pulling or yanking on an external connector or a cord connected to an external connector, a person hitting an external connector, or similar actions that may result in impact forces or loads on the connectors. Such forces may damage or impact the operability of the connectors.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

Figure 1:
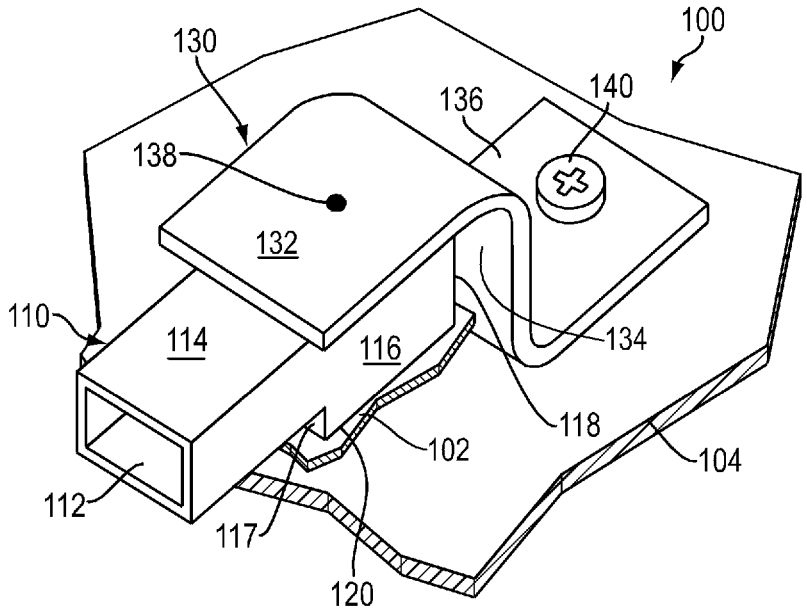
FIG. 1 illustrates an example mounting configuration for facilitating generally vertical movement of a connector in response to external loads, according to an embodiment of the disclosure.

Certain implementations will now be described more fully below with reference to the accompanying drawings, in which various implementations and/or aspects are shown. However, various aspects may be implemented in many different forms and should not be construed as limited to the implementations set forth herein; rather, these implementations are provided so that this disclosure will be thorough and complete, and will fully convey the scope of the disclosure to those skilled in the art. Like numbers refer to like elements throughout.

DETAILED DESCRIPTION

Illustrative embodiments herein are directed to, among other things, configurations for mounting a connector in a device such that external forces or loads applied to the connector may not damage the connector. A user of a device may generate forces or loads on the connector by exerting an excessive amount of force or load on a plug or other external connection that may be inserted into the connector for extending audio, data, or other information to or from a peripheral device, as an example. The user may generate such loads on the connector by tripping over a cord associated with an external connector, pulling or yanking the external connector, hitting the external connector, or similar actions. As non-limiting examples, external connectors may include, but are not limited to, audio jacks, Universal Serial Bus (USB) connectors, High Definition Multimedia Interface (HDMI) connectors, and power supply plugs. Certain embodiments herein relate to connector mount configurations that may absorb loads that impact a connector such that the connector may not become damaged, and may further relate to transferring the load away from the connector to other elements or surfaces associated with a device that may be more capable of withstanding the loads.

Example mount configurations as described herein may include a mounting element, such as a spring, which may be secured to a connector. The mounting element may secure the connector in place until a certain amount of external force or load has been exceeded, at which time the mounting element may deflect, flex, or otherwise bend to allow the connector to move in response to the excessive external force. Such movement of the mounting element may be characterized as the mounting element absorbing the load. In addition to absorbing the load, the mounting element may enable movement of a connector to a point at which the connector engages a wall or surface, such as that associated with a housing of a device, which may further absorb, resist, or accommodate the load to prevent damage to the connector.

Example mount configurations described herein may also determine the direction in which a connector may move in response to external forces or loads. As non-limiting examples, the type of material used for a mounting element, the various geometric shapes of the mounting element, and the location of the mounting element with respect to the connector may each influence the direction in which a connector moves in response to loads. In one example, a twist in at least one portion of the mounting element may provide movement in multiple planes, such as vertical and/or horizontal movement of the connector, depending more particularly on factors such as the amount of the twist, the surface of the connector to which the mounting element is secured, the angles of the mounting element (e.g., right angles or more rounded angles), etc. Numerous other factors, configurations, and examples may exist in other embodiments, some of which are described below in greater detail.

FIG. 1 depicts an example mounting configuration 100 for facilitating vertical movement of a connector in response to external forces or loads, according to an embodiment of the disclosure. The connector 110 and the mounting element 130 may be components within or disposed within a housing associated with a device (not shown), such as a tablet, a smart phone, a laptop, etc. Such devices may include circuits that may be integrated on substrates (e.g., electrical substrates), such as a flexible printed circuit 102 or a printed circuit board (PCB) 104. The substrates 102 and 104 may also be disposed within the housing. Elements other than the substrates 102 and 104 may be used for mounting or securing the connector 110 and the mounting element 130 in other embodiments, some of which will be described in greater detail below. As shown in FIG. 1, the flexible printed circuit 102 may be associated with a different plane than the PCB 104. For example, the flexible printed circuit 102 may be located at a distance above the PCB 104 and may be in contact with the bottom surface 120 of the connector 110.

A flexible printed circuit as described herein may refer to a flexible substrate onto which electronic devices may be mounted and allowed to flex by virtue of one or more materials used to form the flexible printed circuit. As shown in FIG. 1, the area between the bottom surface 120 and the PCB 104 may represent an area into which the connector 110 may move into and out of to facilitate movement of the connector 110. Thus, the flexible printed circuit 102 may facilitate movement of the connector 110, including vertical and/or horizontal movement, which may occur as a result of external forces or loads being applied to the connector 110. The connector 110 may be electrically coupled or otherwise attached to the flexible printed circuit 102 via soldering or another interconnection technique for integrating the connector 110 into the flexible printed circuit 102.

Example materials that may be used to form the flexible printed circuit 102 may include various base materials, conductive materials, and adhesive materials, as non-limiting examples. Examples of base materials may include, but are not limited to, polyester (PET), polyimide, polyether ether ketone (PEEK), polyetherimide (PEI), or other plastic substrates. Examples of conductive materials may include metals, such as copper, copper alloys, or other types of metals. Adhesive materials may include various types of polyimide adhesives or other adhesives for creating a bonding medium for creating a laminate over the base material of the flexible printed circuit 102.

The PCB 104 may, among other things, provide support for the mounting element 130 and may include electronic components that may be connected via electronic pathways or signal traces etched into copper sheets laminated onto a substrate base associated with the PCB 104. As compared to the flexible printed circuit 102, the PCB 104 may be a more rigid surface that may provide less vertical and horizontal movement of components attached to it. At least a portion of the PCB 104 may be dedicated for receiving at least a portion of the mounting element 130 (e.g., the base mounting portion 136) and a screw or other fastener for securing the mounting element 130 to the PCB 104.

The flexible printed circuit 102 and the PCB 104 in FIG. 1 are not meant to be limiting. For example, the mounting element 130 (e.g., the base mounting portion 136) may also be mounted to a flexible printed circuit (e.g., the flexible printed circuit 102) that may extend underneath both the connector 110 and the mounting element 130. According to this example, a mounting element 130 may require additional flexibility to assist in transferring forces or loads away from the connector 110. Such a mounting element may be associated with a rigid design or materials that may be generally more resistive to flexing or bending caused by external forces. In other embodiments, the mounting element 130 may be mounted to more rigid surfaces, such as a mid-frame, a frame, or a housing associated with a device. Examples of the various types of mount configurations will be described in greater detail below.

The connector 110 may be configured to receive a plug or other external connector through a mouth, aperture, or an opening 112 disposed in the connector 110. The plugs or connectors may include, but are not limited to, audio jacks, USB connectors, HDMI connectors, power supply plugs, or other external connectors associated with audio, data, text, other content or information, electrical current, etc. The opening 112 may include numerous shapes and sizes that may vary according to the size or fit of an external plug. For example, the generally rectangular shape of the opening 112 shown in FIG. 1 may receive USB connectors or other generally rectangular external connectors. As another example, the opening 112 may include a generally circular shape for receiving audio jacks or other generally round external connectors. Numerous other shapes of the opening 112 may exist in other examples.

The connector 110 may also include various surfaces on which the mounting element 130 may be attached to facilitate absorption of forces or loads and, in at least some instances, the subsequent transfer of the loads to walls or surfaces that may withstand the loads. Such surfaces may include a top surface 114, a bottom surface 120, multiple side surfaces 116 (e.g., a right side surface 116 as shown and an opposing left side surface (not shown)), a front end or front surface 117, and a rear surface 118 opposite the front surface 117. As will be described in greater detail below, the mounting element 130 may be attached to at least a portion of these surfaces to enable movement of the connector 110 in multiple planes, such as vertical and/or horizontal movement. The connector 110 may include different shapes or configurations that may include fewer or more surfaces in other embodiments.

As described, the mounting element 130 may function to secure the connector 110. According to one embodiment, the mounting element 130 may include a first end and a second end configured to provide movement of the connector 110 in at least one plane within a housing associated with a device. A base mounting portion 136 (or a first portion) may extend from the first end and may be coupled to an electrical substrate, such as the PCB 104. A top mounting portion 132 (or a second portion) may extend from the distal second end and may be coupled to the connector 110. In one aspect of the embodiment, a central mounting portion 134 (or a spring portion) may be disposed between the first portion and the second portion and may be configured to allow movement of the second end of the mounting element 130 and the connector 110 in at least one plane upon application of a force on the connector. The base mounting portion 136 (or first portion) may extend in a first plane, and the top mounting portion 132 (or second portion) may extend in a second plane that is parallel or substantially parallel to the first plane, in one embodiment.

As shown in FIG. 1, the top mounting portion 132 may be secured to the top surface 114 of the connector 110, while the base mounting portion 136 may be secured to the PCB 104. In one embodiment, the mounting element 130 may secure the connector 110 in place until a certain amount of load or force (e.g., an excessive amount of force), beyond which the mounting element 130 may no longer maintain its rest position shown in FIG. 1, is applied to the connector 110. When such an amount of force is received, the mounting element 130 may deflect, flex, or otherwise bend to absorb the load. Such functionality may be provided by the configuration of the mounting element 130 as shown in FIG. 1. As described, the mounting element 130 may include a top mounting portion 132, a base mounting portion 136, and a central mounting portion 134 that may connect the top mounting portion 132 to the base mounting portion 136. In some embodiments, the mounting element 130 may include a top mounting portion 132, a base mounting portion 136, and a spring or flexible member between the top mounting portion 132 and the base mounting portion 136.

In one embodiment, the top mounting portion 132 and the base mounting portion 136 may extend from the central mounting portion 134 in opposing directions and may be perpendicular, or at least substantially perpendicular, to the central mounting portion 134. Each or at least a portion of these mounting portions, to different extents in some embodiments, may bend to facilitate deflection or bending of the mounting element 130 when an excessive amount of force or load is applied to the connector 110 to which the mounting element 130 is attached. For example, in one embodiment, deflection of the mounting element 130 may include the top mounting portion 132 of the mounting element 130 moving upwards or downwards such that the angle formed at the intersection of the central mounting portion 134 increases or decreases, respectively, in response to external forces. The central mounting portion 134 may also bend to facilitate such movement, in one embodiment. The base mounting portion 136 may remain largely stationary by virtue of its attachment to the PCB 104 via a screw or other fastener 140. In some embodiments, however, the base mounting portion 136 may also bend to facilitate deflection or movement of the mounting element 130 in response to loads. In this way, the mounting element 130 may function as a spring or a spring system, which may react to excessive external loads applied to the connector 110.

In the manner described above, the mounting element 130 may be described as cooperating with the connector 110. Such cooperation may be characterized by the mounting element 130 manipulating the connector 110 in response to excessive external forces or loads. For example, the mounting element 130 may cooperate with the connector 110 to allow the connector 110 to move in a generally vertical direction in response to such external forces. As another example, the mounting element 130 may cooperate with generally horizontal forces to allow the connector 110 to move in a generally horizontal direction in response to such external forces. Various other components may also cooperate with such tendencies of external forces, including the flexible printed circuit 102 which, as described, may allow the connector 110 to move vertically, horizontally, tilt, etc., in response to loads.

The mounting element 130 may be comprised of various types of materials to facilitate the above movements. Such materials may include, but are not limited to, beryllium copper, phosphor bronze, aluminum bronze, stainless steel, and other copper, bronze, and steel materials, as well as various plastic materials. Other materials that may retain their shapes after repeated stress and/or strain, as well as other suitable characteristics for mounting a connector in a device, may also be used.

Various types of fasteners may be used to secure the mounting element 130 to the connector 110 and to a support element, such as the PCB 104. Example fasteners may include laser welds, screws, glue, tape, other adhesive substances, clips, etc. In the embodiment shown in FIG. 1, a laser weld 138 may be used to secure the mounting element 130 to the connector 110. The laser weld 138 is shown as a dotted circle to indicate that it may appear between the top mounting portion 132 and the top surface 114 of the connector 110. Also as shown in FIG. 1, a screw 140 may be used to secure the base mounting portion 136 to the PCB 104 or another substrate, as non-limiting examples. Various other types of fasteners, such as those described above, may be used to secure the base mounting portion 136 to the PCB 104 in other embodiments.

The mounting element 130 described in FIG. 1 is not meant to be limiting. For example, various types of mounting elements may provide the same or similar functionality including, but not limited to, a spring or spring mass system, components that include semi-rigid support materials (which may include portions that are rigid and other portions that are not rigid), or other components that may deflect, flex, or otherwise bend in response to a certain amount of force being applied to the connector 110. Such components may include various shapes, requirements for responding to external forces, or other characteristics. For example, according to certain embodiments, a particular shape of a mounting element, as well as other characteristics, may enable the mounting element to resist a certain amount of force before deflecting. For example, a mounting element that has right angles connecting the top mounting portion 132 and/or the base mounting portion 136 to the central mounting portion 134 may provide greater resistance to loads than a mounting element that has more curved respective angles in association with a spring, according to an example design. Numerous other examples, which may include different degrees of angles, materials, mounting positions, or other attributes associated with a mounting element that may influence its functionality or responsiveness to loads, may exist in other embodiments.

Figure 2A:
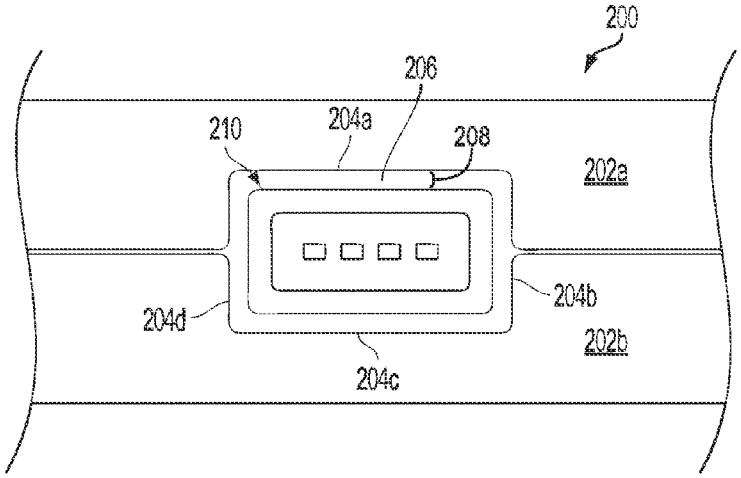
FIG. 2A illustrates a front view of a connector in a housing, according to an embodiment of the disclosure.

FIG. 2A depicts a front view of a connector in a housing, according to an embodiment of the disclosure. The example housing may include one or more apertures through which a connector may receive an external connector, such as an audio jack, a USB connector, an HDMI connector, a power supply plug, etc. In this way, the aperture may provide access to the connector from a location outside of the housing. In one embodiment, the housing may be the enclosure for a device (e.g., a tablet, a smart phone, a laptop, etc.) that surrounds electrical circuitry and components, among other elements, in the device. As shown in FIG. 2A, an aperture 206 in the housing, such as an aperture formed by the adjoining of housing sides 202*a* and 202*b*, or an aperture formed by the disposition of such aperture in at least one of the sides 202*a* and 202*b* or another side portion of the housing (not shown), may include at least a portion of a connector 210. In this way, the connector 210 may be at least partially disposed within the housing.

An air gap distance 208 may exist between the connector 210 (e.g., the mouth or opening 212 as shown in FIG. 1) and at least two edges of the edges 204*a*, 204*b*, 204*c*, or 204*d* that form the aperture 206 when the connector 210 is at rest, according to one embodiment. In this way, the connector 210 may be described as being disposed adjacent to the aperture 206. The air gap distance 208 may be the same on all sides of the connector 210 in one embodiment, or may vary in other embodiments. An example distance for the air gap distance 208 may include approximately 0.2 millimeters (mm), as a non-limiting example.

Figure 2B:
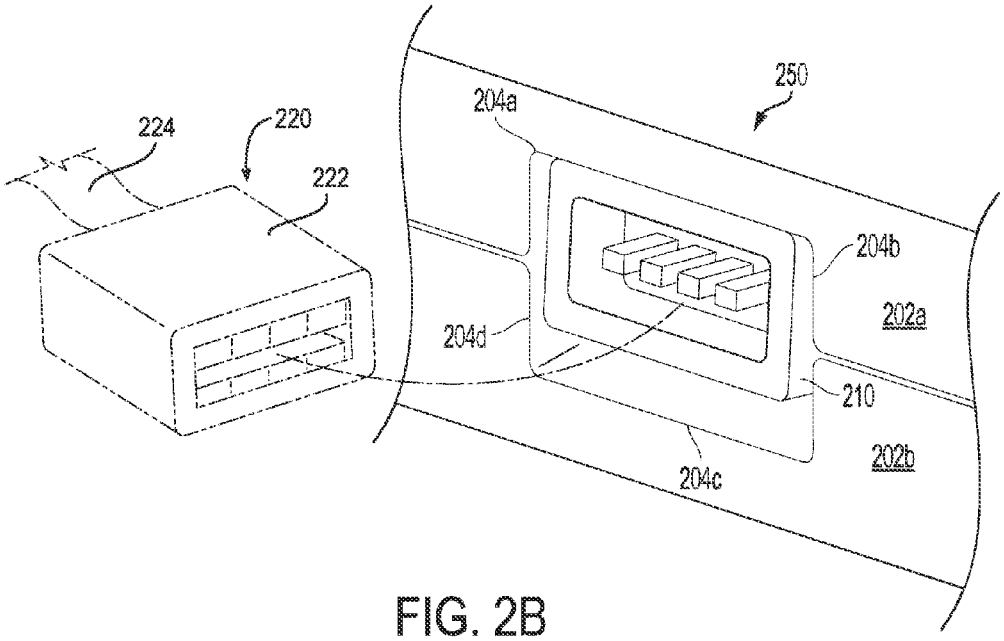
FIG. 2B illustrates a front view of a connector in contact with an edge of the housing in FIG. 2A after a load has been applied to the connector, according to an embodiment of the disclosure.

As described above, a mounting element, such as the mounting element 130 in FIG. 1, may absorb external forces or loads applied to a connector to which the mounting element 130 is secured. After a certain amount of load or force is applied to the connector 210 in FIG. 2B, or upon application of the load or force on the connector 210 (which may be caused by a user tripping over or yanking a cord 224 or a connecting portion 222 associated with an external connector 220 that may be inserted into the connector 210, as non-limiting examples), the mounting element 130 may deflect and move the connector 210 to fill in at least a portion of the air gap 206, in one embodiment. In a further embodiment, the mounting element 130 may move the connector 210 until the connector 210 contacts at least one edge of the housing (e.g., an edge 204*a*, 204*b*, 204*c*, or 204*d*), or other surface associated with a device. As shown in FIG. 2B, the connector 210 may move in a generally vertical direction (e.g., via the mounting element 130) until it contacts the edge 204*a* of the housing. As shown, the connector 210 may be angled or tilted with respect to the edge 204*a* when it contacts the edge 204*a*. Various degrees of angles or tilt may exist in various embodiments, depending on the design of the mounting element 130, among other factors. The mounting element 130 may also move the connector 210 to the other edges 204*b*, 204*c*, or 204*d* in response to other directional external forces, or as a result of different configurations of the mounting element 130, each of which will be described in greater detail below.

Figure 3A:
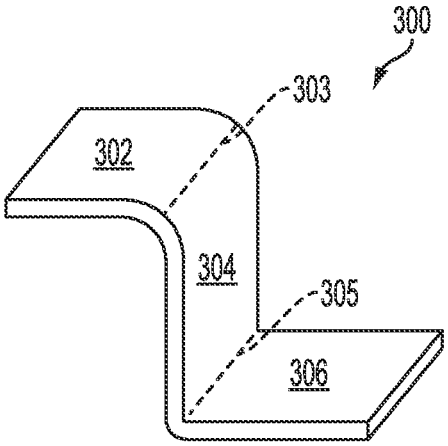
FIGS. 3A-3D illustrate various shapes of a mounting element that may facilitate movement in various directions or planes in response to loads, according to an embodiment of the disclosure.

FIGS. 3A, 3B, 3C, and 3D illustrate various configurations of mounting elements 300, 360, 380, and 390, respectively, that may facilitate movement of a connector (e.g., the connector 110 in FIG. 1) in various directions or planes in response to forces or loads applied to the connector. The mounting element 300 in FIG. 3A may be embodied by the mounting element 130 in FIG. 1, in one embodiment. As shown in FIG. 3A, the mounting element 300 may include a first end and a second end distal from the first end. Mounting portions, for example, a top mounting portion 302 (or a first portion), and a base mounting portion 306 (or a second portion), may be located at the first end and the second end, respectively, in one embodiment. The top mounting portion 302 may include, but is not limited to, a surface for receiving a connector. The base mounting portion 306 may include, but is not limited to, a surface for coupling to a surface associate with a device, such as a PCB. The mounting element 300 may further include a connecting central mounting portion 304, such as a spring or other flexible element, in one embodiment.

The mounting element 300 may be considered to be at rest as shown in FIG. 3A, where the top mounting portion 302 and the base mounting portion 306 may be perpendicular or substantially perpendicular to the central mounting portion 304 (or spring portion). The top mounting portion 302 and the base mounting portion 306 may each extend in a respective plane. As shown in FIG. 3A, such planes may be parallel to one another. As shown in other embodiments, such as FIG. 3C, such planes may be substantially perpendicular to one another, as will be described in greater detail below. As further depicted in FIG. 3A, angles associated with the top mounting portion 302 and the base mounting portion 306 with respect to the central mounting portion 304 may vary. For example, the angle associated with the base mounting portion 306 extending from the central mounting portion 304 may be parallel, while the angle associated with the top mounting portion 302 extending from the central mounting portion 304 may not be exactly parallel, but may be substantially parallel or at some other angle with respect to the central mounting portion 304.

The dotted lines 303 and 305 may demarcate example boundaries for the mounting portions. In one embodiment, the dotted lines 303 and 305 may represent joints or points generally along which the mounting element 300 may flex or bend in response to external forces that are applied to a connector to which the mounting element 300 may be mounted. Bending of the mounting element 300 in response to such external forces may be characterized by an increase or a decrease in the angles formed by the top mounting portion 302 and the base mounting portion 306 extending from the central mounting portion 304. Such angles may increase or decrease in spring-like fashion in response to external forces, according to one embodiment. Other portions of the mounting element 300 (e.g., other than the joints along the dotted lines 303 and 305) may also bend or flex in response to external forces to facilitate the spring-like motion of the mounting element 300.

The mounting element 300 may therefore facilitate generally vertical movement of a connector attached to the mounting element 300, in one embodiment. For example, in response to a vertically directed external force, the mounting element 300 may deflect upward or downward to transfer the external force away from the connector to, for example, one or more edges of a housing or other surfaces of a device that may be better suited for absorbing such forces without becoming damaged. Movement of the mounting element 300, and hence the connector (e.g., the connector 110 in FIG. 1) to which the mounting element 300 may be mounted, may cease upon at least a portion of the connector contacting the edge of the housing or other suitable surface, at which point the external forces may be considered to be transferred, according to one embodiment.

FIG. 3A also illustrates angles of varying degrees, as described above. For example, the angle at the joint (dotted line) 305 may be substantially a right angle, while the angle at the joint (dotted line) 303 may have more curvature. In other examples, a right angle may exist at the joint (dotted line) 303, while a more curved angle may exist at the joint (dotted line) 305. Both, or neither, of the joints may be right angles, in yet other examples.

Figure 3B:
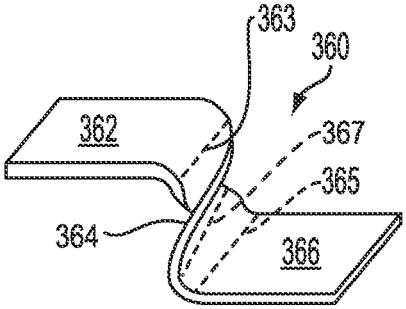
Figure 3C:
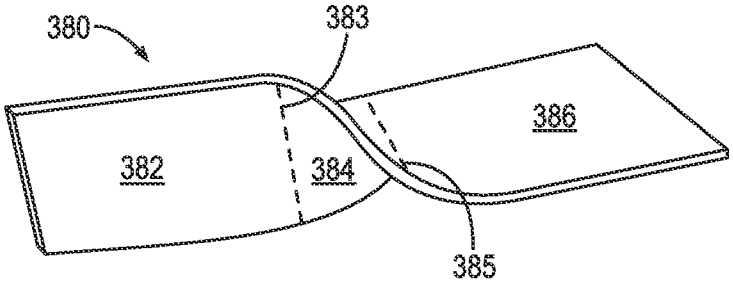
Figure 3D:
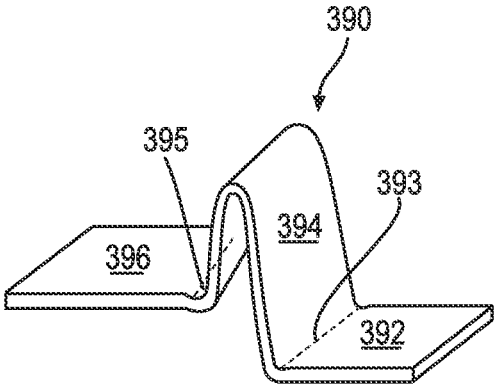

The illustrations in FIGS. 3B, 3C, and 3D may represent variations of the mounting element 300 in FIG. 3A. For example, the mounting element 360 (e.g., the central mounting portion 364 or spring portion) in FIG. 3B may include a twist, as shown. The twist may be characterized by at least one curved surface of the central mounting portion 364. The curved surface may facilitate the mounting element 360 moving a connector (e.g., the connector 110 in FIG. 1) to which it may be mounted (e.g., via a top mounting portion 362) in a generally horizontal direction such that the twist may appear to at least partially straighten out or flatten before returning to its rest position shown in FIG. 3B, in one embodiment. In this manner, the mounting element 360 may deflect, flex, snap, or otherwise bend in response to a certain amount of force or load applied to a connector to which the mounting element 360 may be mounted, in one embodiment. The imaginary dotted lines 363, 365, and 367 may represent joints along which the mounting element 360 may move, according to one embodiment. For example, the mounting element 360 may move vertically along joints (dotted lines) 363 and/or 365 and horizontally and/or diagonally along joint (dotted line) 367, in certain embodiments. In other embodiments, the mounting element 360 may move more generally in one or more planes in response to forces or loads. As described above, a base mounting portion 366 may be coupled to a substrate (e.g., PCB 104 in FIG. 1) or other surface associated with a device in which the mounting element 360 may be located.

FIG. 3C depicts a mounting element 380 that may enable vertical and/or horizontal movement of a connector to which it may be attached. As shown in FIG. 3C, a right angle (or substantially right angle) twist may exist in the central mounting portion 384 (or spring portion) such that the top mounting portion 382 (or a first portion of the mounting element 380) is associated with a plane that is perpendicular or substantially perpendicular to a plane associated with the base mounting portion 386 (or second portion of the mounting element 380). In one embodiment, the top mounting portion 382 may correspond to the top mounting portion 302 in FIG. 3A, the base mounting portion 386 may correspond to the base mounting portion 306 in FIG. 3A, and the central mounting portion 384 may correspond to the central mounting portion 304 in FIG. 3A before the right angle twist is applied to the mounting element 380.

In one embodiment, the top mounting portion 382 may be mounted to a side surface of a connector (not shown) (e.g., the side surface 116 of the connector 110 in FIG. 1) to enable the connector to move in a horizontal direction. For example, the mounting element 380 may bend or flex generally along the joint (dotted line) 383 to facilitate such movement. In another embodiment, the mounting element 380 may enable the connector to move in a vertical direction, for example, by flexing or bending generally along the joint (dotted line) 385. As described above, such movements may occur in association with the mounting element 380 absorbing forces or loads that may impact the connector to which the mounting element 380 may be attached. In addition to absorbing such loads, the mounting element 380 may further move the connector until the connector contacts a wall or surface associated with a housing that may withstand the loads.

FIG. 3D depicts a mounting element 390 that may enable vertical movement of a connector to which it may be attached. As shown, the mounting element 390 may include a base mounting portion 392 (or a first portion), a top mounting portion 396 (or a second portion), and a connecting central mounting portion 394, which may include a spring portion or other flexible portion that may be disposed between the top mounting portion 396 and the base mounting portion 392. The flatness or steepness of the angle associated with the central mounting portion 394 may vary in different embodiments, depending on the desired load resistance of the mounting element 390, among other factors. In one embodiment, a connector (not shown) (e.g., the connector 110 in FIG. 1) may be secured to the top mounting portion 396. For example, the bottom surface 120 of the connector 110 in FIG. 1 may be secured to the top mounting portion 396 via a laser weld or other attachment mechanism. Further, according to this embodiment, a substrate (e.g., the flexible printed circuit 102) may be mounted on top of the connector (e.g., the top surface 114 of the connector 110 in FIG. 1).

In response to a certain amount of force or load, the mounting element 390 may flex or bend along the joint (dotted line) 395 and/or the joint (dotted line) 393 to move a connector to which the mounting element 390 may be attached in a vertical direction, and may do so until the connector contacts a surface of a housing that may withstand the force, in one embodiment. In some embodiments, the mounting element 390 may include a twist in the central mounting portion 394 (e.g., which may be similar to the twist in the central mounting portion 364 in FIG. 3B in one embodiment) to enable horizontal movement in addition to the vertical movement described in association with FIG. 3D.

The above illustrations in FIGS. 3A-3D are not meant to be limiting. Numerous other designs, shapes, curvatures, etc., for the mounting element 390 and/or the connector to which the mounting element 390 may be mounted may exist in other embodiments. For example, as described, the central mounting portions 304, 364, 384, and 394 of the mounting members 300, 360, 380, and 390, respectively, may be spring portions or other flexible portions that may connect the top mounting portions and the base mounting portions shown. Such members may include one or more curved surfaces, angles, or various shapes to facilitate spring-like movement that may accompany spring members or similarly flexible members, as a non-limiting example.

Figure 4:
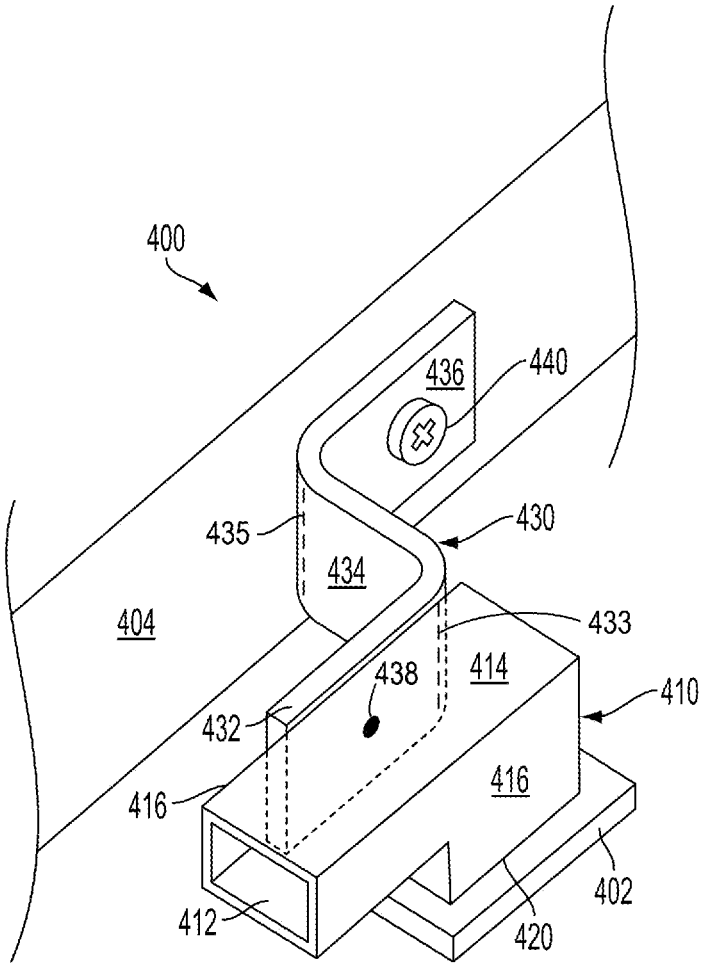
FIG. 4 illustrates an example mounting configuration for facilitating horizontal movement of a connector in response to external forces, according to an embodiment of the disclosure.
Figure 5:
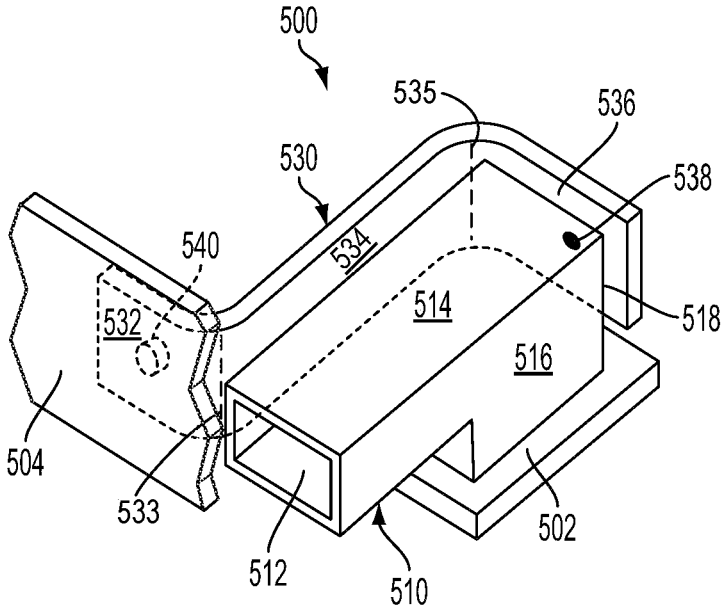
FIG. 5 illustrates an example mounting configuration for facilitating movement of a connector in generally a horizontal direction, according to an embodiment of the disclosure.
Figure 6:
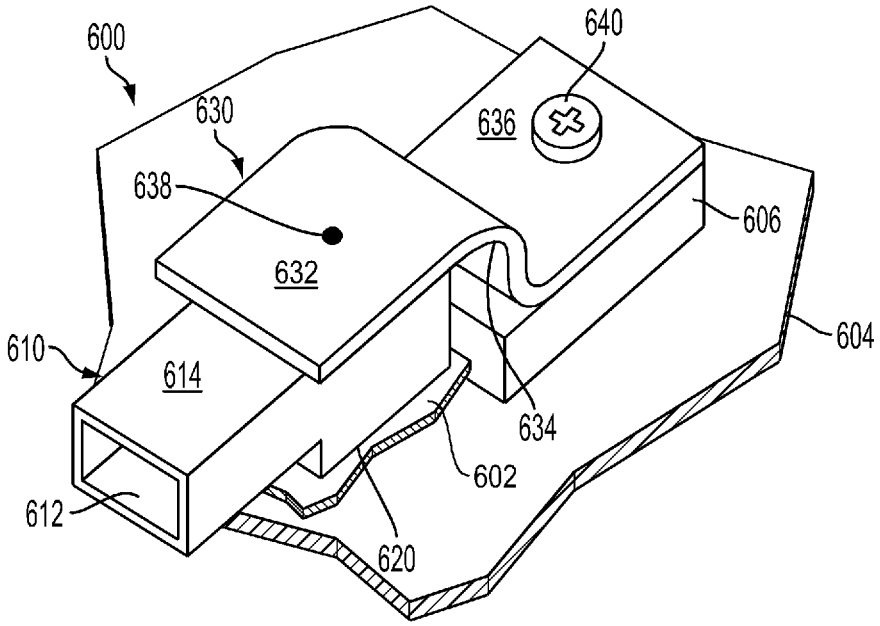
FIG. 6 illustrates an example mounting configuration in which generally vertical movement of a mounting element is facilitated by a pliable element, according to an embodiment of the disclosure.

FIGS. 4-6 illustrate various ways in which a mounting element (e.g., the mounting element 300 in FIG. 3A) may be mounted to a connector (e.g., the connector 110 in FIG. 1) to provide movement in multiple planes, such as vertical and/or horizontal movement. Each of the mounting elements in FIGS. 4-6 may, for example, include a first end and a second end distal from the first end. The first end may include a first portion or a top mounting portion that extends in one plane, and the second end may include a second portion or a base mounting portion that extends in a second plane, in some configurations.

As an example, the mounting configuration in FIG. 4 may be used to facilitate horizontal movement of a connector in response to a load impacting the connector, according to an embodiment of the disclosure. As shown in FIG. 4, a first portion or a top mounting portion 432 may be secured to a side surface 416 of the connector 410 via a laser weld 438 or other fastener, while a second portion or a base mounting portion 436 may be secured to a mid-frame 404 or other structural element in a device via a screw 440 or other fastener. The connector 410 may include a mouth or opening 412 for receiving external connectors, as well as a top surface 414, multiple side surfaces 416, and a bottom surface 420. The connector 410 may be mounted to a substrate, such as the flexible printed circuit 402.

In the same or similar fashion to that described in FIG. 1 and FIG. 3A, the mounting element 430 may deflect, flex, or bend, for example, along the joint (dotted line) 433 and/or the joint (dotted line) 435, in association with the mounting element 430 absorbing a force or load impacting the connector 410. When such a load is received, the mounting element 430 may deflect to allow the connector 410 to move in a generally horizontal direction until at least a portion of the connector 410 contacts one or more edges of a housing along a horizontal axis, such as the edges 204*b* and 204*d* in FIG. 2A, according to one embodiment. In one embodiment, the mounting element 430 may embody the mounting element 130 in FIG. 1, and it may instead be attached to the side surface 416 of the connector 410 rather than to the top surface 114 of the connector 110 in FIG. 1. In another embodiment, the mounting element 430 may include one or more twists, such as a twist in the central mounting portion 434, to facilitate vertical movement in addition to, or as an alternative to, the described horizontal movement.

FIG. 5 illustrates an example mounting configuration 500, which may facilitate movement of a connector in generally a horizontal direction, according to an embodiment of the disclosure. Such movements may be caused by a user pushing an external connector into the mouth or opening 512 of the connector 510, or pulling the external connector along generally the same plane. As shown in FIG. 5, one end 536 of a mounting element 530 may be secured to a rear surface 518 of a connector 510 via a laser weld 538 or other fastener, while another end 532 may be secured to a portion 504 of a device (e.g., a side edge 202*b* of a housing in FIG. 2B) or another support element of a device, such as a mid-frame, via a screw 540 or other fastener. As previously described, the connector 510 may be mounted to a substrate, such as a flexible printed circuit 502, in one embodiment. The connector 510 may also include a top surface 514 and one or more side surfaces 516 to which the mounting element 530 may be secured in other embodiments.

According to the configuration in FIG. 5, the mounting element 530 may flex or bend, for example, along the joint (dotted line) 535 and/or the joint (dotted line) 533 to move a connector to which it may be attached in a direction toward and/or away from a central axis of a housing in which the connector may be mounted, or generally in a horizontal direction. In this way, the mounting element 530 may absorb forces or loads, and in certain embodiments, may move the connector until it contacts a surface of another component within the housing (not shown) that may be capable of withstanding the forces or loads. In one embodiment, the mounting element 530 may embody the mounting element 130 in FIG. 1, and it may instead be attached to the rear surface 518 of the connector 510 rather than to the top surface 114 of the connector 110 in FIG. 1. In another embodiment, the mounting element 530 may include one or more twists, such as a twist in the central mounting portion 534, to facilitate vertical movement in addition to, or as an alternative to, the described horizontal movement.

As another example, FIG. 6 depicts an example mounting configuration 600 that may allow a connector 610 to move in a generally vertical direction, for example, in response to forces applied to an external connector inserted into an opening 612 in the connector 610, in one embodiment. The example configuration 600 may include, but is not limited to, a mounting element 630, which may have inflexible or rigid mounting portions 632, 634, and 636, a pliable element 606, and a fastener 640 for securing the mounting element 630 and the pliable element 606 to a support element, such as a PCB 604. In one embodiment, the fastener 640 may secure the base mounting portion 636 of the connector 610 to the pliable element 606, while a bottom surface of the pliable element 606 may be secured to the PCB 604 (or other substrate or material) via an adhesive substance (e.g., glue, tape, etc.) or various other fasteners identified above. A top surface 614 of the connector 610 may be secured to the top mounting portion 632 of the mounting element 630 via a laser weld 638 or other attachment mechanism, and a bottom surface 620 may be mounted to a flexible printed circuit 602, according to one embodiment.

The pliable element 606 may compress and expand to allow the mounting element 630 to move the connector 610 in generally a vertical direction in response to loads impacting the connector 610. Example pliable materials may include rubber, foam (e.g., foam padding), plastics, or other flexible materials. The flexible printed circuit 602, as described, may also facilitate vertical movement of the connector 610.

Figure 7:
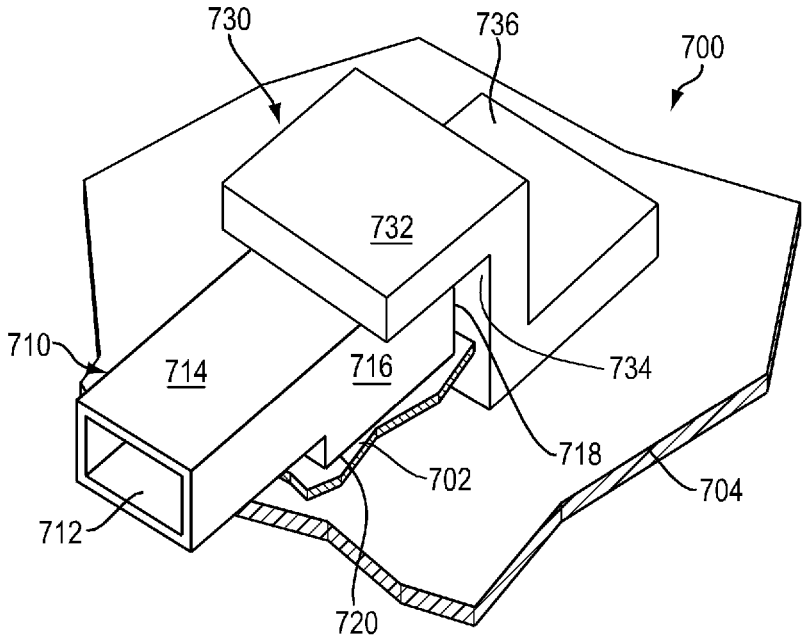
FIG. 7 illustrates an example mounting configuration in which a pliable material is used to facilitate movement of a connector, according to an embodiment of the disclosure.

As a further example, FIG. 7 illustrates an example mounting configuration in which a pliable material is used to facilitate movement of a connector, according to an embodiment of the disclosure. A pliable mounting element 730 may include the pliable materials mentioned in FIG. 6 (e.g., rubber, foam, plastics, or other flexible materials), in one embodiment. The pliable mounting element 730 may include, but is not limited to, a first end and a second end distal from the first end. The first end may include a first portion or a top mounting portion 732 that extends in one plane, while the second end may include a second portion or a base mounting portion 736 that may extend in another plane. In one embodiment, such first and second planes may be parallel or substantially parallel to one another. In another embodiment, the planes may be perpendicular or substantially perpendicular to one another. A central mounting portion 734 (such as a spring portion) may be disposed between the top mounting portion 732 and the base mounting portion 736, in various embodiments.

As shown in FIG. 7, the top mounting portion 732 of the pliable mounting element 730 may be secured or coupled to the top surface 714 of the connector 710, while the base mounting portion 736 may be secured or coupled to the PCB 704, according to one embodiment. The flexibility of the pliable element 730 may facilitate movement of the connector in generally any direction or plane in response to forces or loads, which may be applied to an external connector inserted into the opening 712 of the connector 710, in one embodiment. According to one example, the pliable mounting element 730 may absorb such external forces and may further move the connector 710 to one or more edges of a housing or other surfaces associated with a device in which the pliable mounting element 730 may be located. In other embodiments, the pliable mounting element 730 may be secured or coupled to a side 716 or a rear 718 of the connector 710 to facilitate such movement.

Portions of the pliable mounting element 730 may be secured or coupled to the connector 710 via various fasteners, such as glue, tape, other adhesives, etc. In one embodiment, an adhesive substance may secure the top mounting portion 732 to the top surface 714 of the connector 710, as well as secure the bottom mounting portion 736 to the PCB 704. As described above, the bottom mounting portion 736 may also be secured to mid-frame, housing, or other surfaces associated with a device in which the mounting element 730 may be located. A bottom surface 720 of the connector 710 may be secured or coupled to a flexible printed circuit 702, or other substrates or surfaces, via various fasteners such as those described above.

The configurations described above are non-limiting and are provided as examples of various components or elements that may be used to mount a connector in a manner that enables such components or elements to absorb forces or loads that may impact the connector, as well as move the connector to a wall, a surface, a component, or other element that may be capable of withstanding the forces or loads. Although specific shapes, materials, arrangements, or positioning of mounting elements, connectors, substrates, pliable materials, fasteners, etc., are shown, numerous others may exist in other embodiments.

Further, the use of directional terms, such as vertical or horizontal, are not meant to be limiting. Such terms may describe a general direction in which mounting elements, connectors, or other components herein may move. For example, configurations described herein may also support diagonal movement of mounting elements and connectors, or generally any movement in one or more planes, in response to loads. Such movement may be enabled via the various positions of the mounting elements with respect to a connector, either alone or in conjunction with a twist, or other geometric variations of the mounting elements, as non-limiting examples. The components or elements illustrated in the accompanying figures may also not be drawn to scale. For example, curves, shapes, or dimensions associated with the various components in the figures may not be actual but may instead provide an example of the features or attributes associated with the various types of mounting elements described herein.

As used herein, the term "device" may refer to any computing component that includes one or more processors that may be configured to execute computer-readable, computer-implemented, or computer-executable instructions. Example devices can include personal computers, server computers, server farms, digital assistants, smart phones, personal digital assistants, digital tablets, Internet appliances, application-specific circuits, microcontrollers, minicomputers, transceivers, or customer premise equipment such as set-top boxes, kiosks, or other processor-based devices, or other computing components that may receive external connections for extending information to or from the computing components.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language is not generally intended to imply that certain features, elements, and/or operations are in any way required for one or more implementations.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. An electrical device comprising:

a first electrical substrate;

a second electrical substrate;

a housing having at least one aperture, wherein the first and second electrical substrates are disposed within the housing;

a connector electrically coupled to the first electrical substrate and at least partially disposed within the housing, wherein the aperture provides access to the connector from a location outside of the housing, wherein the connector is configured to receive an external connector; and a mounting element secured to the connector, the mounting element comprising a plurality of portions configured to move the connector in at least one plane and in at least one direction upon application of an external force applied to the connector, the configuration of the plurality of portions comprising:

a spring portion comprising a first end and a distal second end, the spring portion comprising a semi-rigid material;

a first portion extending from the first end of the spring portion and coupled to the second electrical substrate; and a second portion distal from the first portion and extending from the second end of the spring portion, the second portion coupled to the connector and comprising a semi-rigid material;

wherein the movement is enabled in part by at least one of an extension of the second portion from the spring portion or an extension of the first portion from the spring portion.

2. The device of claim 1, wherein the first portion extends from the spring portion in a first substantially perpendicular direction and the second portion extends from the spring portion in a second substantially perpendicular direction, wherein the first substantially perpendicular direction is substantially opposite the second substantially perpendicular direction.

3. The device of claim 2, wherein the first portion extends along a first plane and the second portion extends along a second plane, and wherein the first plane is parallel to the second plane.

4. The device of claim 3, wherein the first portion extends along a first plane and the second portion extends along a second plane, and wherein the first plane is substantially perpendicular to the second plane.

5. The device of claim 1, wherein the external connector comprises at least one of an audio plug, a Universal Serial Bus (USB) plug, a high definition multimedia interface (HDMI) plug, or a power supply plug.

6. The device of claim 1, wherein the first electrical substrate and the second electrical substrate are at least one of a flexible printed circuit or a printed circuit board (PCB).

7. An electrical device comprising:

a housing comprising a plurality of sides and an aperture disposed in at least one of the sides;

a mounting element disposed within the housing, the mounting element comprising:

a spring portion comprising a first end and a distal second end;

a first portion extending from the first end of the spring portion; and a second portion distal from the first portion and extending from the second end of the spring portion; and a connector coupled to the mounting element and disposed adjacent to the aperture and configured to receive an external connector, wherein the mounting element is configured to move the connector in at least one plane and in at least one direction upon application of an external force applied to the connector by the external connector.

8. The device of claim 7, wherein each of the second portion and the connector comprises a top surface and an opposing bottom surface;

wherein the top surface of the connector is coupled to the bottom surface of the second portion of the mounting element; and wherein the first portion of the mounting element is coupled to at least one of a substrate or the housing, and wherein the at least one plane in which the connector is configured to move is vertical.

9. The device of claim 7, wherein the second portion comprises a vertically extending top surface, the top surface coupled to a side surface of the connector;

wherein the first portion of the mounting element is coupled to at least one of a frame or the housing; and wherein the at least one plane in which the connector is configured to move is horizontal.

10. The device of claim 7, wherein the second portion comprises a first surface;

wherein the connector comprises:

a front end having an aperture disposed therein; and a rear surface facing opposite the front end;

wherein the first surface of the second portion is coupled to the rear surface of the connector;

wherein the first portion of the mounting element is coupled to the housing; and wherein the at least one plane in which the connector is configured to move is horizontal.

11. The device of claim 7, wherein the second portion comprises a semi-rigid material that configures the mounting element to move the connector in the at least one plane.

12. The device of claim 11, wherein the second portion is coupled to the connector and the first portion is coupled to at least one of an electrical substrate or the housing.

13. The device of claim 12, wherein the spring portion comprises at least one curved surface configured to move the connector in at least one second plane, wherein the at least one second plane is substantially horizontal.

14. The device of claim 7, further comprising a pliable element, wherein at least a portion of the pliable element is disposed between the first end of the mounting element and the housing, the pliable element configured to compress to allow the connector to move along the at least one plane.

15. The device of claim 7, wherein the mounting element is coupled to the connector via at least one of a laser weld, a screw, or an adhesive substance.

16. The device of claim 7, wherein the external connector comprises at least one of an audio plug, a Universal Serial Bus (USB) plug, a high definition multimedia interface (HDMI) plug, or a power supply plug.

17. The device of claim 7, wherein the mounting element comprises a pliable material.

18. An electrical device comprising:

at least one electrical substrate;

a housing having at least one aperture, wherein the at least one electrical substrate is disposed within the housing; and a mounting element comprising:

a first end and a second distal end, the mounting element further comprising a first portion extending from the first end in a first plane; and a second portion extending from the second distal end in a second plane;

wherein the first portion is coupled to a connector via at least one of a weld, a screw, or an adhesive substance, and the second portion is coupled to the at least one electrical substrate, wherein the connector is configured to receive an external connector, wherein the mounting element comprises a spring portion disposed between the first portion and the second portion.

19. The device of claim 18, wherein the first plane is substantially perpendicular to the second plane.

20. The device of claim 18, wherein the first plane is substantially parallel to the second plane.

21. The device of claim 18, wherein the spring portion comprises a semi-rigid material that configures the spring portion to move the connector in at least one of the first plane and a first direction or the second plane and in a second direction upon application of a force on the connector.

22. The device of claim 21, wherein the first portion and the second portion are substantially perpendicular to the spring portion.

23. The device of claim 18, wherein the at least one electrical substrate comprises a first electrical substrate, wherein the second portion is coupled to a second electrical substrate of the at least one electrical substrate via at least one of a weld, a screw, or an adhesive substance.

* * * * *